US009802131B2

(12) United States Patent
Zamperla

(10) Patent No.: US 9,802,131 B2
(45) Date of Patent: Oct. 31, 2017

(54) AMUSEMENT RIDE FOR HANG GLIDING SIMULATION

(71) Applicant: ANTONIO ZAMPERLA S.P.A., Altavilla Vicentina (IT)

(72) Inventor: Alberto Zamperla, Altavilla Vicentina (IT)

(73) Assignee: ANTONIO ZAMPERLA S.P.A., Altavilla Vicentina (IT)

( * ) Notice: Subject to any disclaimer, the term of this patent is extended or adjusted under 35 U.S.C. 154(b) by 0 days.

(21) Appl. No.: 15/059,978

(22) Filed: Mar. 3, 2016

(65) Prior Publication Data

US 2016/0184717 A1 Jun. 30, 2016

Related U.S. Application Data

(63) Continuation of application No. PCT/EP2014/059126, filed on May 5, 2014.

(51) Int. Cl.

| | |
|---|---|
| ***A63G 1/30*** | (2006.01) |
| ***A63G 1/10*** | (2006.01) |
| *A63G 1/00* | (2006.01) |

(52) U.S. Cl.
CPC *A63G 1/30* (2013.01); *A63G 1/10* (2013.01)

(58) Field of Classification Search
CPC ... A63G 1/00; A63G 1/10; A63G 1/24; A63G 1/28; A63G 1/30
USPC ..... 472/29, 31–24, 39, 47
See application file for complete search history.

(56) References Cited

U.S. PATENT DOCUMENTS

| | | | | |
|---|---|---|---|---|
| 2,282,763 | A * | 5/1942 | Kennedy | A63G 1/30 472/39 |
| 4,898,377 | A | 2/1990 | Roche | |
| 5,820,469 | A * | 10/1998 | Nobbs, Jr. | A63G 1/28 472/3 |
| 8,162,768 | B2 * | 4/2012 | Nemeth | A63G 1/24 472/130 |

(Continued)

FOREIGN PATENT DOCUMENTS

| | | |
|---|---|---|
| CN | 202 460 090 | 10/2012 |
| DE | 34 01 199 | 8/1985 |
| FR | 2 618 690 | 2/1989 |

(Continued)

OTHER PUBLICATIONS

International Search Report, dated Jan. 27, 2015, issued in corresponding International Application No. PCT/EP2014/059126.

*Primary Examiner* — Kien Nguyen
(74) *Attorney, Agent, or Firm* — Andrews Kurth Kenyon LLP

(57) ABSTRACT

An amusement ride includes a plurality of main arms which are moved by at least one motor along a circular path about a central rotation axis arranged substantially vertical to the ground, or to a platform. The main arms are rotatable about a rotation axis so that a first portion, which extends with respect to the rotation axis, can be raised or lowered with respect to the ground. The ride further includes at least one seat for at least one rider connected to the first portion of the main arm, at least one movable aerodynamic surface, and a control device for modifying the angle of incidence of the aerodynamic surface with respect to the air flow impacting it during the rotation of the main arm about the central axis.

31 Claims, 16 Drawing Sheets

(56) References Cited

U.S. PATENT DOCUMENTS 8,388,458 B2 * 3/2013 Buhler ..... A63G 1/10
472/130

FOREIGN PATENT DOCUMENTS

| | | |
|---|---|---|
| GB | 19 988 | 0/1910 |
| GB | 405 422 | 2/1934 |
| GB | 494 070 | 10/1938 |

* cited by examiner

AMUSEMENT RIDE FOR HANG GLIDING SIMULATION

CROSS-REFERENCE TO RELATED APPLICATIONS

The present application is a continuation of PCT International Patent Application No. PCT/EP2014/059126, having an international filing date of May 5, 2014, which is expressly incorporated herein in its entirety by reference thereto.

FIELD OF THE INVENTION

The present invention relates to amusement rides and theme park rides, and in particular to amusement ride for the flight simulation, and in particular of the hang-gliding flight.

In the ride described herein, a plurality of seats for accommodating one or more riders are moved by rotation along a circumferential path and seats are provided with an aerodynamic surface and control device for modifying the angle of incidence of the aerodynamic surface with respect to air flow impacting on the aerodynamic surface during the rotation of the main arm, to cause a raising or lowering movements of the main arm and of the seats connected thereto.

BACKGROUND INFORMATION

Amusement rides are very popular; park operators and ride producers are therefore seeking to improve the entertainment experience of the riders of the amusement rides.

There are disclosed in the literature apparatus for the flight simulation on an airplane, such as U.S. Pat. No. 4,898,377. The apparatus disclosed therein includes an airplane which is connected to an arm rotatable about a vertical axis.

The arm is also movable about a horizontal axis, perpendicular with respect to the vertical axis, so as the airplane can climb and descend during its rotation movement about the vertical axis. The thrust force allowing the rotation of the airplane about the vertical axis is generated by a propeller of the airplane driven by a motor.

French Published Patent Application No. 2 618 690 discloses an amusement apparatus for simulating the flight, and in particular the flight with hang-gliders.

A delta wing is connected to a main arm rotating about a vertical axis. The arm can be also moved up and down, so as to simulate raising and lowering (climbing and descending) movements. A horizontal bar held by the rider allows the rider to impart the rotational movement to the hang-glider about the vertical axis, while the rider is running, The horizontal bar is also operated by the rider to control the climbing and descending movements.

However, a problem of the devices of the documents briefly discussed above, and of other conventional devices, is the limited amount of riders they can transport.

The use of these devices also requires an athletic rider who can fly in a prone position (French Published Patent Application No. 2 618 690) or a long loading time (U.S. Pat. No. 4,898,377).

In fact, the above discussed devices are provided with only one rotating arm to which the airplane or the hang-glider is connected, so that only one rider can use the device.

This is a problem for the park operators and ride producers which are continuously aiming to improve the rider capacity for their rides, to reduce the waiting time for riders.

A further problem is to provide the riders with improved rides that better simulate real rides on sport and/or that could provide the riders with enhanced emotions.

In particular, in the device described in French Published Patent Application No. 2 618 690, the rider has to run very fast in order to reach the required minimum velocity to generate the minimum lift force necessary for climbing.

The necessity of running on the ground combined with the raising/lowering movement could be dangerous for the rider, especially when the rotation velocity is reduced and the glider descends. In fact, in this situation the legs of the rider impact on the ground.

Thus, the ride disclosed in French Published Patent Application No. 2 618 690 is not suitable for a common person.

SUMMARY

Example embodiments of the present invention provide an amusement ride with increased rider capacity, i.e. which is able to increase the number of the transported riders. Moreover, example embodiments of the present invention provide an amusement ride suitable to increase the fun and the entertainment experience provided to the riders, and also increase the interaction between the riders during the ride movement while respecting the safety requirements of the amusement rides.

The amusement ride according to an example embodiment of the present invention includes a plurality of main arms which are moved along a circular path by at least one motor about a central rotation axis (preferably in correspondence of a central hub). The central axis is arranged substantially vertical to the ground, or to a platform. The main arms are rotatable about a rotation axis arranged so that a first portion extends with respect to the rotation axis. The rotation of the main arm about the rotation axis allows the first portion to be raised or lowered with respect to the ground, together with at least one seat for the rider connected to the first portion of the main arm.

The main arms may be rotatable about a rotation axis arranged between two ends of the main arm so that a first portion and a second portion extend opposite one to another with respect to the rotation axis.

At least one counterweight, or similar device, may be provided to balance the main arm about the rotation axis. The counterweight is arranged on the second portion of the main arm to balance the weight of the first portion of the main arm and in particular of the rider accommodated on the seat.

The amusement ride further includes at least one movable aerodynamic surface and control device for modifying the angle of incidence of the aerodynamic surface with respect to air flow impacting it during the rotation of the main arm about the central axis, to cause the raising or lowering movements of the first portion of the main arm and of the seat connected thereto.

In combination with, or in alternative to, the modification of the angle of incidence of the aerodynamic surface to cause the raising or lowering movements of the first portion of the main arm and of the seat connected thereto, the control device of the amusement ride modifies the angle of incidence of the aerodynamic surface to control the movement of the one or more seats with respect to the main arm. In fact, as disclosed in greater detail later, the at least one seat can be movable with respect to the main arm, and preferably the seat is rotatable with respect to the main arm about a rotation axis (C). More in detail, the modification of the angle of incidence of the aerodynamic surface, and in particular of at least one flight control portion of the aerodynamic surface, allows for control of the movement of the seat with respect to the main arm.

The presence of one or more seat(s) connected to the main arms allows for an increase in the safety of the ride. In fact, the rider(s) are accommodated on the seat thus avoiding direct contact between the rider and the ground during the movement of the ride.

The rider body position is also suitable for an average person.

Additionally, the presence of a plurality of main arms to which one or more seat(s) are connected allow for an increase in the rider capacity of the amusement ride.

In particular, the rotation axis of the main arm is distanced from the central rotation axis and, preferably the entire main arm is arranged laterally with respect to the central rotation axis.

In other words, the main arm does not intersect the central rotation axis, that is preferably substantially vertical with respect to the ground.

The main arms may be completely arranged laterally with respect to the central rotation axis thus allowing to increase the number of main arms which can be connected to central axis, and in particular to a central hub, for the movement along the circular path.

The ride may include at least one support element, e.g., in the form of a circular support bar, to support the plurality of main arms, e.g., in correspondence of the rotation axis of the main arm.

The seat may be connected in a rotatable manner to the first portion of the main arm, about a rotation axis (C), which is, e.g., substantially parallel with respect to the rotation axis of the main arm.

The rotation of the seat with respect to the main arm may allow for an increase in the fun and the entertainment experience provided to the riders.

In particular, the rotation of the seat with respect to the main arm is free and it depends at least partially on the aerodynamic force generated by the aerodynamic surface.

In this regard, the control device is used to control the rotation of the seat with respect to the main arm. The aerodynamic surface can be provided with at least one flight control portion, e.g., movable with respect to at least one main portion of the aerodynamic surface, in order to control the rotation movements of the seat with respect to the main arm.

In particular, a pair of flight control portions movable in opposite directions, one with respect to another, can be used to control the rotation movement of the seat with respect to the main arm.

The riders may directly control the raising/lowering movements of the seats and/or the movement of the seat with respect to the main arm. The control device of the amusement ride is operated by the rider accommodated on the seat to control the inclination of the aerodynamic surface, e.g., by controlling the rotation of the aerodynamic surface with respect to a rotation axis, and/or to control the movement of the seat with respect to the main arm, e.g., by controlling the movement of at least one flight control portion of the aerodynamic surface.

Other features, advantages, and details appear, by way of example only, in the following detailed description of example embodiments, the detailed description referring to the appended Figures.

DETAILED DESCRIPTION

Figure 1:
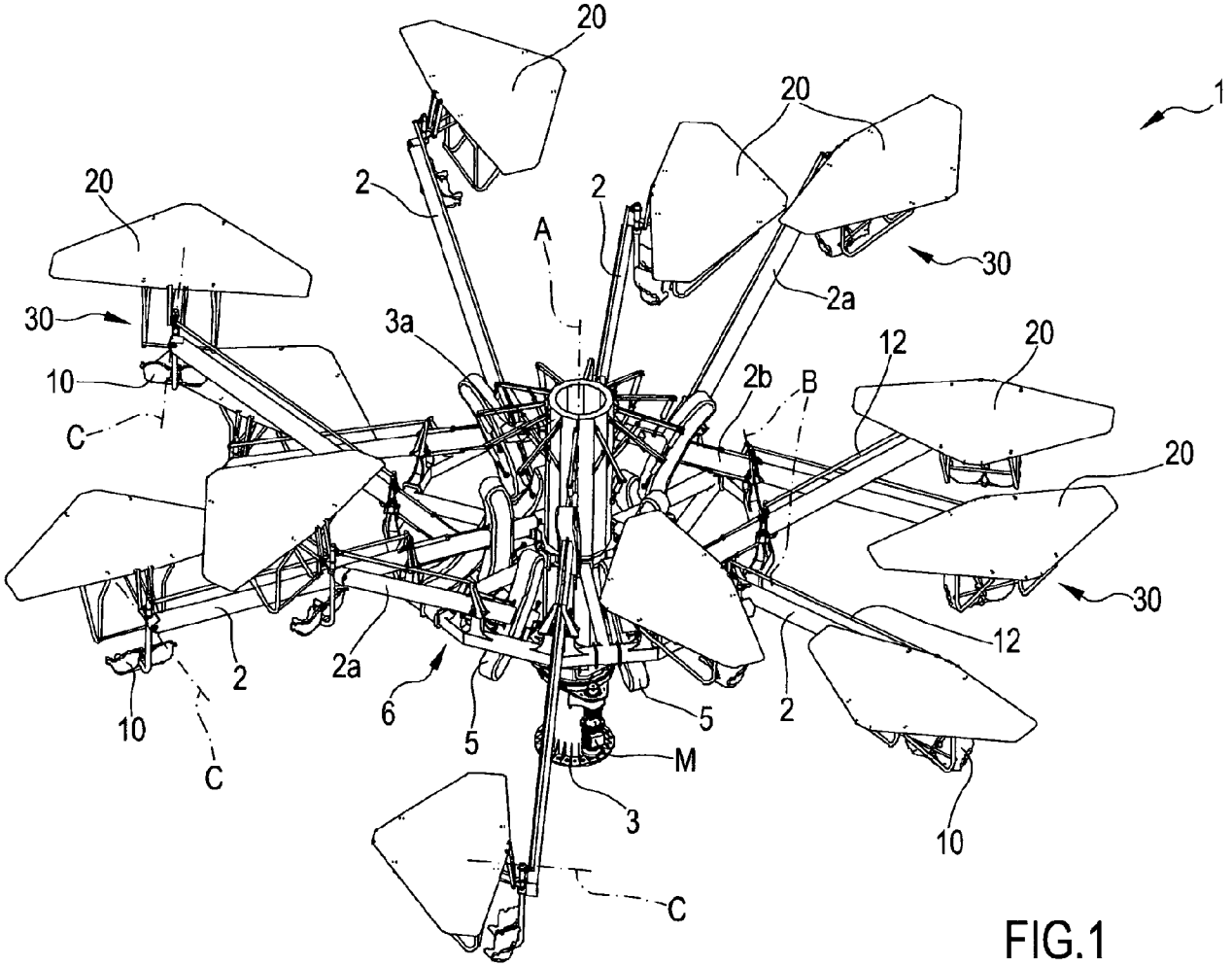
FIG. 1 is a perspective view of an amusement ride according to an example embodiment of the present invention during its operation.
Figure 2:
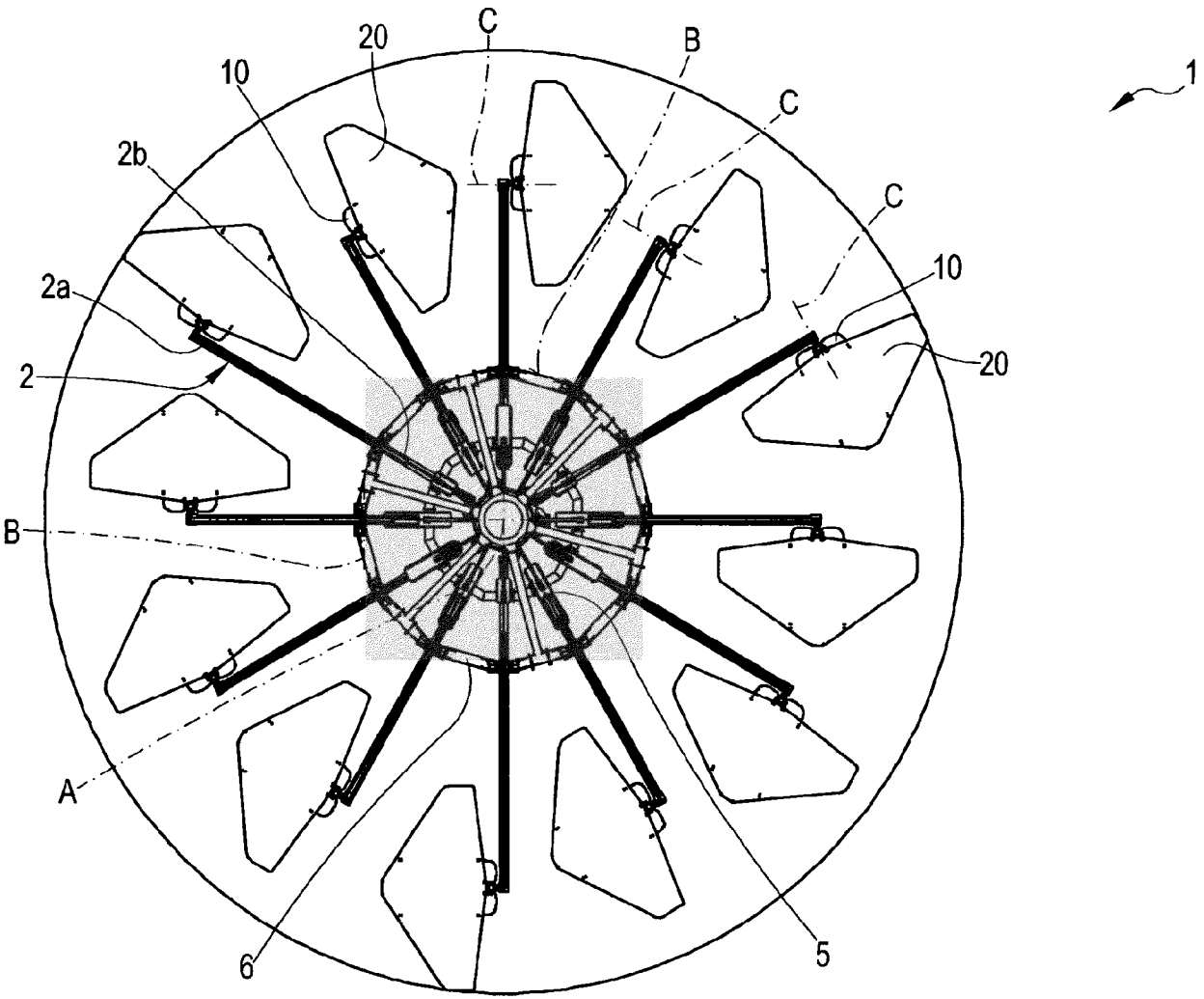
FIG. 2 is a plan view, from above, of a ride according to an example embodiment of the present invention.
Figure 2A:
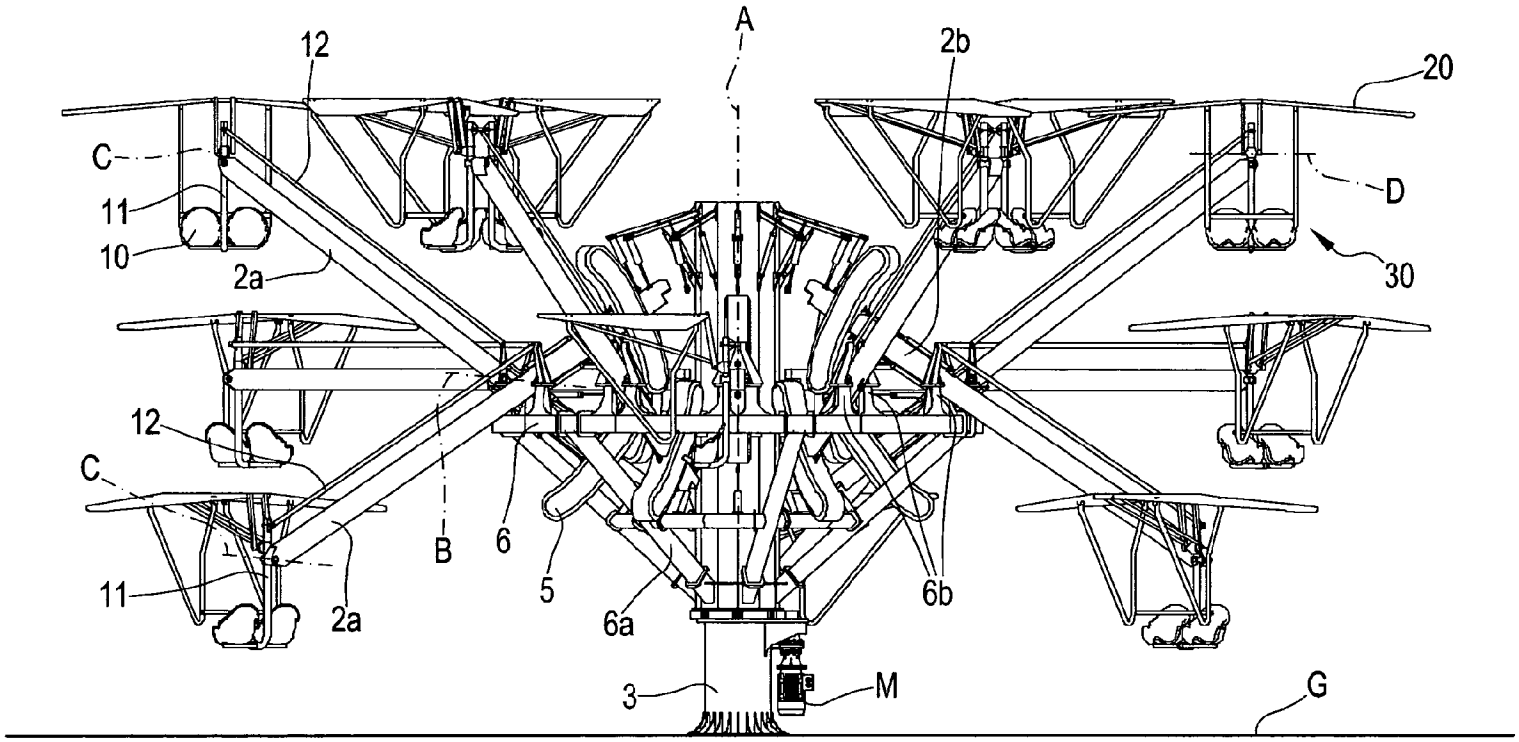
FIG. 2*a* is a lateral view of a ride according to an example embodiment of the present invention.

As illustrated in the Figures, the amusement ride 1 includes a plurality of main arms 2 and at least one motor M to move the arms 2 along a circular path about a central rotation axis A, fixed on the ground G (see FIG. 2*a*), or on a platform. The central axis A is arranged substantially vertical to the ground G, or to a platform.

The main arms 2 are rotated about a central hub 3 having a central rotation axis A.

It has to be noted that the reference to a platform is used herein to indicate a generic horizontal plane, on which the amusement ride 1 can be arranged.

The amusement ride 1 includes at least one seat 10, for one or more rider, which is connected to a first portion 2*a* of the main arm 2, and at least one movable aerodynamic surface 20 connected to a control device 30 for modifying the angle of incidence of the aerodynamic surface with respect to air flow impacting it during the rotation of the main arm about the central axis A, to cause a raising or lowering (climbing or descending) movements of the first portion 2*a* of the main arm 2 and thus of the seat 10 connected thereto.

The amusement ride includes a central hub 3 fixed on the ground, or on the platform, having a central rotation axis A, and preferably a substantially vertical rotation axis A.

The main arms 2 can be constrained to the central hub 3 so that they can be rotated by the motor M with respect to the central hub 3, or according to another possible arrangement, the main arms 2 can be fixed to the central hub 3 and also the central hub is rotated about the central axis A by the motor M.

The central hub 3 may be fixed to the ground 3, or to a platform, and the main arms 2 may be constrained to an upper part 3*a* of the central hub 3, which is rotatable with respect to the lower part of the central hub 3 fixed to the ground by the motor M.

The at least one motor M may be arranged to engage the main arms 2, or the central hub 3, or the upper part 3*a* of the central hub, to transmit the rotary movement about the central axis A.

Additionally, the motor M may be fixed, i.e. it is not transported in rotation about the central rotation axis A.

The at least one motor M may be arranged in a central position with respect to the plurality of main arms 2, i.e. the motor M is arranged substantially in correspondence of the central axis A.

As already mentioned above, the main arms 2 are rotated about a substantially vertical rotation axis A. The expression substantially vertical is used to indicate that the inclination of the axis of rotation A with respect to the ground, or a generic horizontal plane, can be slightly inclined and, for example, may be between +15° and −15°. The axis of rotation A may be perpendicular to the ground G.

The main arms 2 may extend radially from the central rotation axis A.

The main arms 2 are rotatable about a rotation axis B so that at least a first portion 2*a* of the main arm 2 can be raised or lowered with respect to the ground, or with respect the platform.

The main arm 2 is rotatable about a rotation axis B so that a first portion 2*a* extends with respect to the rotation axis B.

The main arm 2 may extend along a straight line, however different configuration of the main arm 2 can be provided.

The rotation axis B may be arranged between two ends 2*c*, 2*d* (see, for example, FIGS. 3, 3*a*, 4, and 4*a*) of the main arm 2 so that a first portion 2*a* and a second portion 2*b* extend opposite one to another with respect to the rotation axis B.

In other words, the rotation axis B is arranged at a certain point, or area, along the longitudinal elongation of the main arm 2, so that a first portion 2*a* and a second portion 2*b* are formed with respect the rotation axis B.

The first portion 2*a*, e.g., the portion arranged at a greater distance from the central axis A, is longer than the second portion 2*b* of the main arm, which is arranged closer to the central axis A.

The ride 1 further includes at least one lower limit stop 8*a* and/or at least one upper limit stop 8*b* to limit the angle of rotation of the main arm 2 about the rotation axis B.

Figure 3:
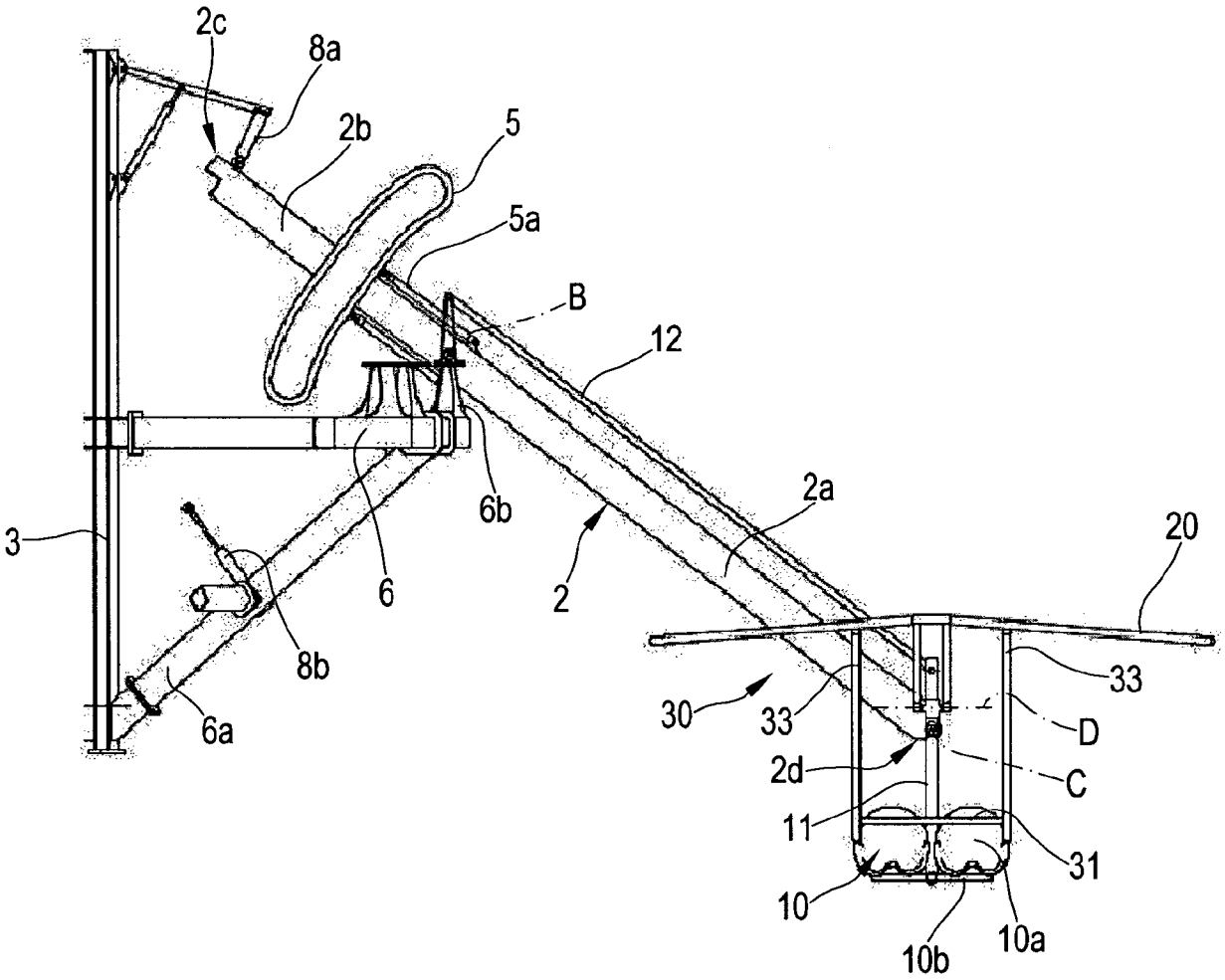
FIG. 3 is a front view of a main arm of a ride according to an example embodiment of the present invention in a lowered position.

The lower limit stop 8*a* prevents a further rotation of the first portion 2*a* of the main arm towards the ground G (clockwise rotation in the view of FIG. 3), and the upper limit stop prevents a further rotation of the first portion 2*a* of the main arm 2 away from the ground G (counterclockwise rotation in the view of FIG. 3).

The upper and lower limit stops 8*a*, 8*b* are intended to be contacted by the second portion 2*b* of the main arm 2.

Notwithstanding this, different configurations of the limit stops can be provided, for example by providing a direct contact of the limit stops with the first portion 2*a* of the main arm 2.

The upper and/or lower limit stops 8*a*, 8*b* can be provided with a damper, or elastic, elements to avoid rigid impact between the main arm 2 and the limit stops.

Figure 3A:
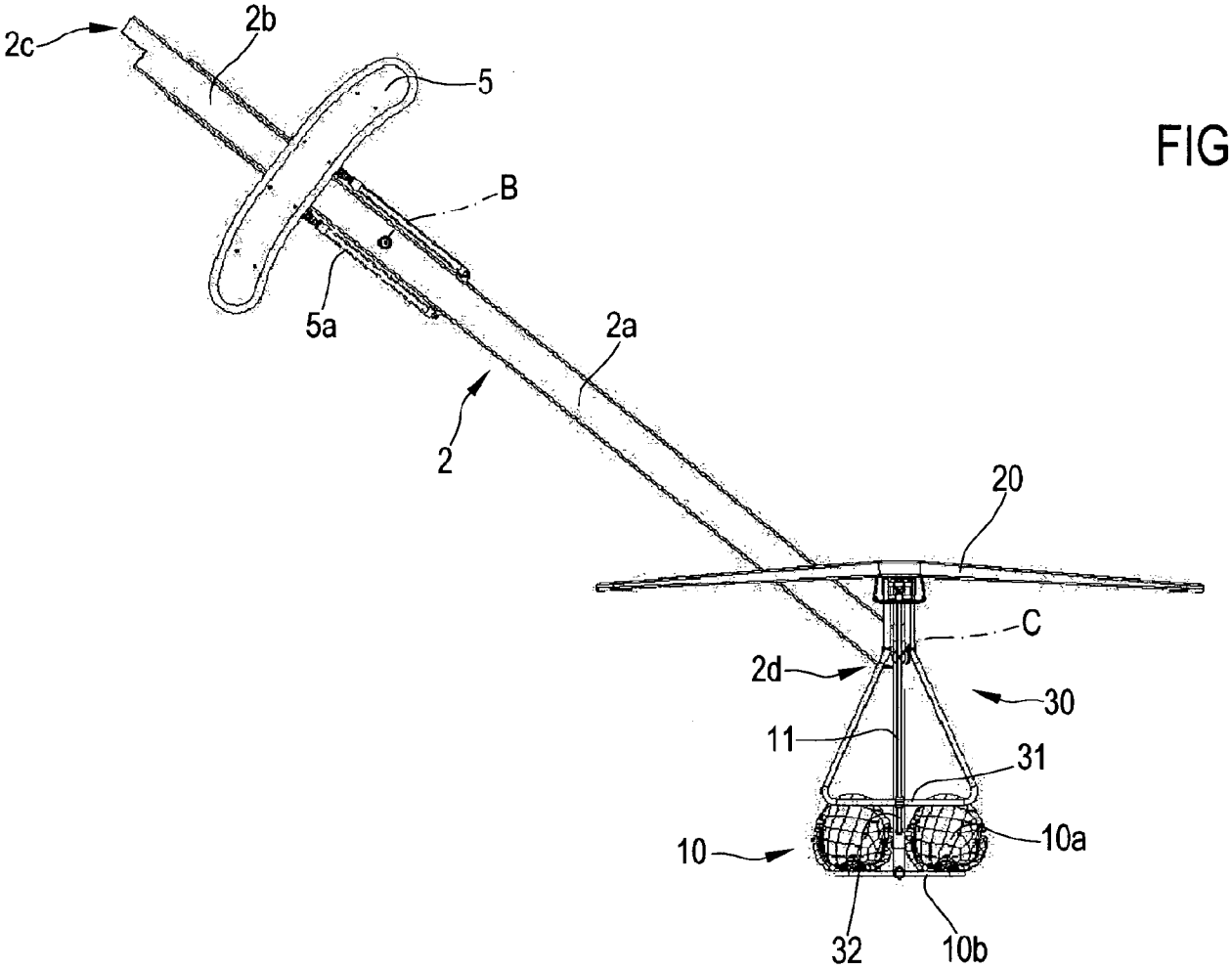
FIG. 3*a* is a front view of a main arm of a ride according to an example embodiment of the present invention in a lowered position.

In FIGS. 3 and 3*a* two different arrangements of the seat 10 and of the aerodynamic surface 20 are illustrated in a lowered position, with the main arm 2 and in particular the second portion 2*b* contacting the lower limit stop 8*a*. This position may be used for the loading/unloading operations of the rider on/from the seat 10.

Figure 4:
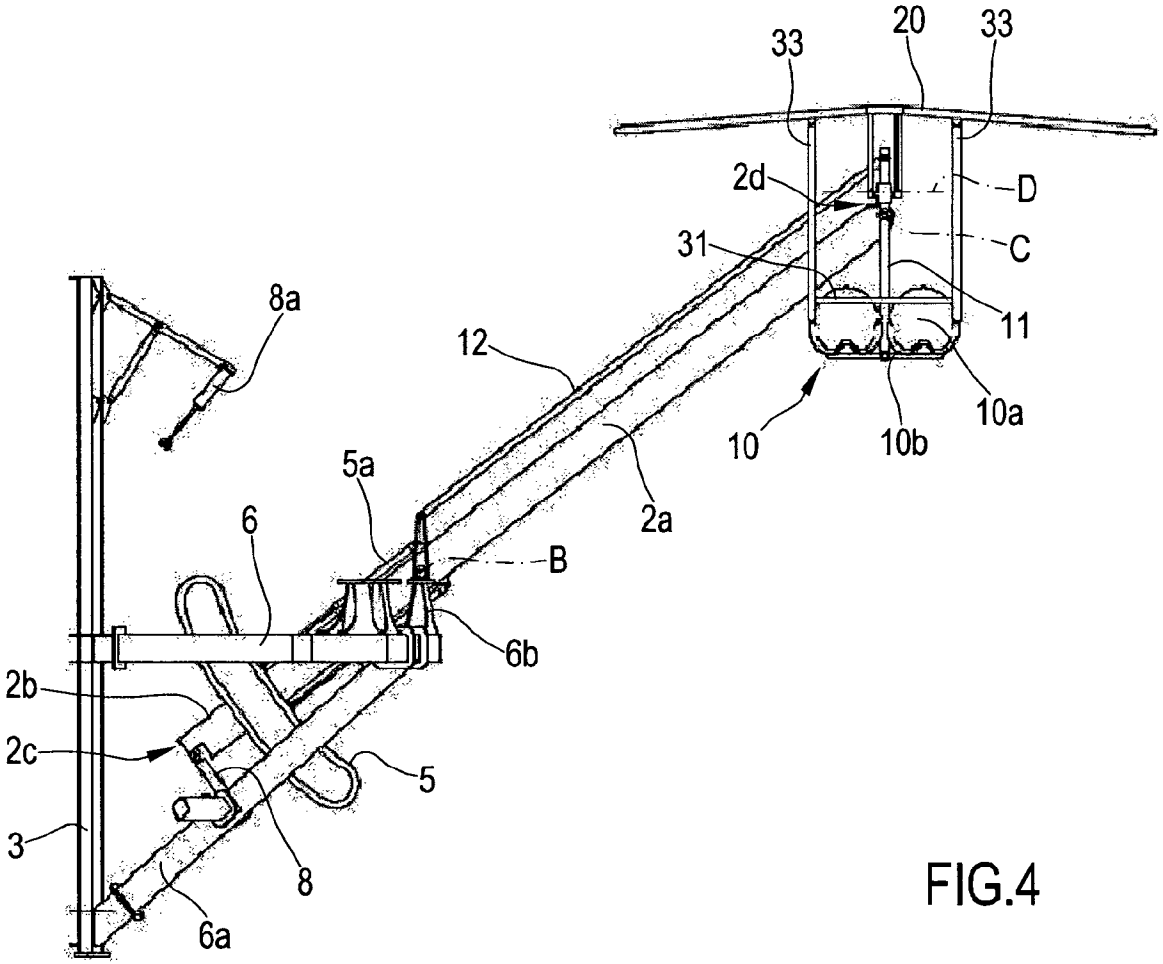
FIG. 4 is a front view of a main arm of the ride illustrated in FIG. 3, during the operation of the ride and in particular in the highest position that can be reached.
Figure 4A:
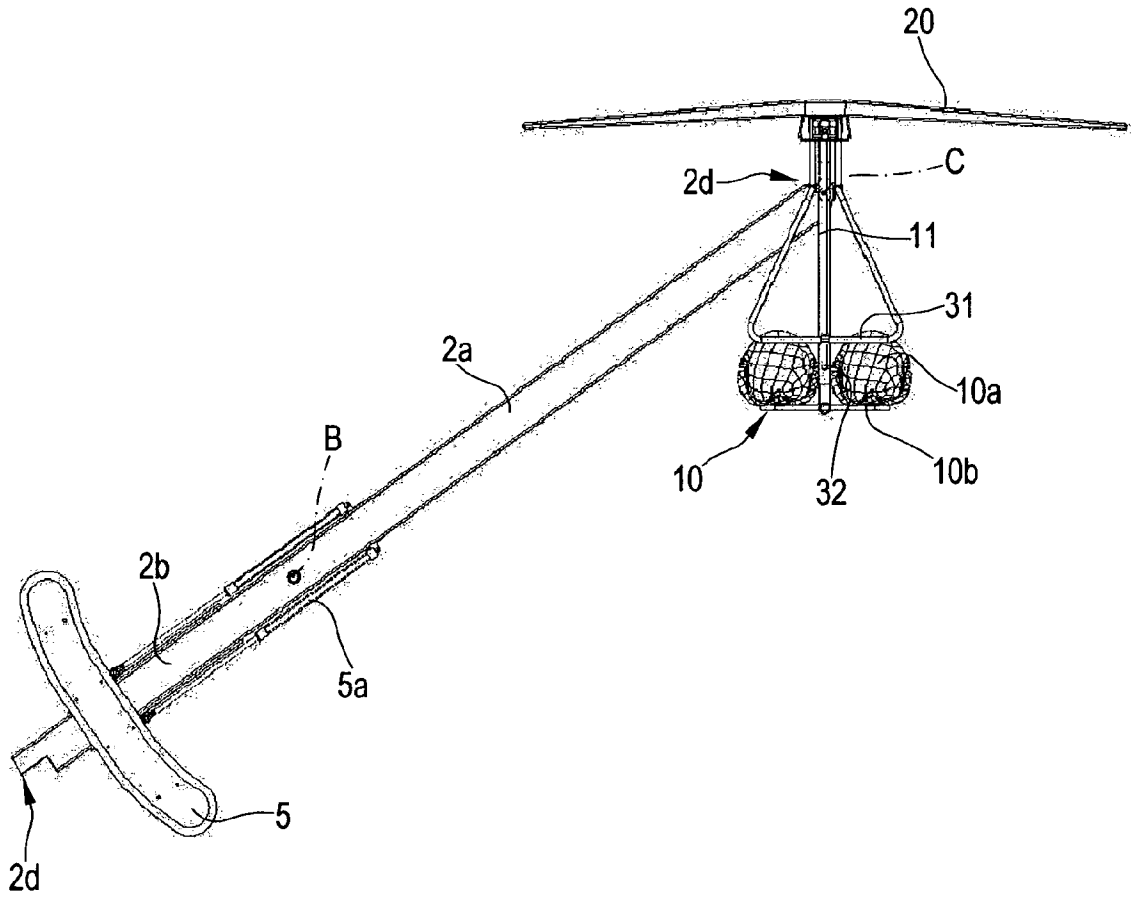
FIG. 4*a* is a front view of a main arm of a ride according to an example embodiment of the present invention during the operation of the ride and in particular in the highest position that can be reached.

In FIGS. 4 and 4*a*, two different arrangements of the seat 10 and of the aerodynamic surface are shown in a upper position, which can be reached during the operation of the device, when the aerodynamic force generated by the aerodynamic surface is such that to lift the main arm 2 and also the seat 10 connected thereto away from the ground. In this position, the main arm 2 and in particular the second portion 2*b* of the main arm 2, is in contact with the upper limit stop 8*b*.

The rotation axis B of the main arm 2 is arranged on a plane that is substantially perpendicular with respect to the central rotation axis A. Moreover, the rotation axis B of the main arm 2 is tangent to the circular path along which the main arm is rotated, or with respect to a circumference having its center in the central rotation axis A.

It follows that the main arm 2, and in particular the first portion 2*a* of the arm 2, may be arranged at a distance from the central axis A, can be raised and lowered with respect to the ground (i.e. the distance of the first portion 2*a* with respect to the ground G can be modified), due to the rotation of the main arm about the rotation axis B.

The rotation axis B of the main arm 2 is distanced from the central rotation axis A.

In particular, the main arms 2 are arranged laterally with respect to the central axis A and at distance from the central axis A. In particular, the distance of the rotation axis B from the central axis A is such that the entire arm 2 is arranged laterally with respect to the central axis A.

By doing so, a greater number of main arms can be arranged on the amusement ride 1. In particular, the main arm 2 does not intersect the central rotation axis A, as in conventional devices, and in particular in the devices described in French Published Patent Application No. 2 618 690 and U.S. Pat. No. 4,898,377.

The amusement ride 1 further includes at least one support element 6 intended to support the main arms 2, e.g., in correspondence of the rotation axis B, which may be arranged at a distance from said central rotation axis A. The support element 6, to which the main arms 2 are constrained, can be rotated about the central axis A.

The central hub 3 may include a support bar 6, e.g., a circular support bar 6, on which the rotation axes B of the main arms 2 are arranged. More in detail, the main arm 2 is rotatably constrained, about the rotation axis B, in correspondence of the circular support bar 6.

Even if specific reference to a circular support bar 6 has been made, according to further possible arrangements, different shapes of the support element 6 of the central hub 3 can be provided.

The circular support bar 6 has its center corresponding to the central axis A. Moreover, the support bar can be further secured and suspended by a plurality of arms 6*a*.

In the arrangement illustrated in the Figures, twelve main arms 2 are constrained to the central hub 3 and two seats 10 are connected to each main arm 2, however, the number of main arms 2 and the number of the seats 10 connected to them can be varied.

In the arrangement illustrated in the Figures, e.g., in particular the detailed views of FIGS. 3 and 4, the main arms are connected to the circular support bar 6 by a pair of supporting columns 6*b* in correspondence of which the rotation axis B is arranged. In other words, the main arm 2 is hinged in correspondence of the columns 6*b* to be rotated about the rotation axis B.

However, different construction of the connection between the main arm 2 and the support bar 6, and in general with the central hub 3 can be provided, while maintaining a rotation of the main arm 2 about the rotation axis B.

The at least one seat 10 for the rider may be connected to the first portion 2*a* of the main arm 2. The at least one seat 10 may be arranged substantially in correspondence of the end of the first portion 2*a*, however the seat 10 can be also arranged at different position along the first portion 2*a* of the main arm 2.

The amusement ride further includes at least one counterweight 5, or similar devices, to balance the main arm 2 about the rotation axis B. The counterweight can be movable with respect to the main arm. More in detail, the counterweight 5 can be movable with respect to the rotation axis B of the main arm 2 in order to modify its distance from the rotation axis B.

The main arm 2 may further include at least one counterweight 5, e.g., arranged in correspondence of the second portion 2*b* of the main arm 2, i.e., in correspondence of the portion of the main arm 2 opposite to the portion 2*a* in correspondence of which the seat 10 for the rider is arranged.

For this purpose, a moving device, such as for example one or more actuators 5*a*, for example, a hydraulic cylinder, can be provided, as for example illustrated in the Figures (see, for example, FIGS. 3, 3*a*, 4, and 4*a*).

The counterweight 5 is intended to balance the weight of the one or more rider accommodated on the seat 10.

The counterweight 5 is movable from a position where it is close to the rotation axis B, illustrated, for example, in FIGS. 3 and 3*a*, so as the first portion 2*a* of the arm 2 is lowered in a position which can be used to load the rider on the seat 10.

The counterweight 5 is moved in order to distance it from the rotation axis B when it is required to balance the weight of the rider accommodated on the seat, so that the aerodynamic force generated by the aerodynamic surface 20 can be able to cause the raising movement of the first portion 10 of the main arm 2 and thus also of the seat 10 connected thereto.

FIGS. 4 and 4*a* illustrate the main arm during the operation of the amusement ride, wherein the counterweight 5 has been distanced from the rotation axis B.

In particular, when the loading operation of the amusement ride has been completed and the rider is accommodated on the seat 10, the counterweight is moved to distance it from the rotation axis B until the arm 2 is in a balanced position with respect to the rotation axis B.

In other words, the counterweight 5 is moved away from the rotation axis B until the weight of the first portion 2*a* of the main arm 2, including also the weight of the rider on the seat 10, is balanced. The movement of the counterweight 5 is stopped when a slight rotation of the arm 2 about the rotation axis B is sensed, for example, by suitable sensors, e.g., an angular position transducer or a bottom position sensor.

It should be understood that the term seat is used herein to indicate an arrangement that is suitable for accommodating riders and holding them in a condition of safety; in greater detail, by the term seat it is meant a structure, e.g., equipped with appropriate safety device(s), for example, safety belts, so as to contain the rider who is being carried.

The seats 10 may be arranged one next to another, in one or more rows. Even if the arrangement illustrated in the Figures two seat are connected to the main arm 2, the number and the arrangement of the seats 10 can be different, for example, depending on the dimension of the amusement ride, the loading capacity, etc.

The seat 10 may include a backrest 10*a* intended to support the back of the rider, and a seat bottom 10*b*.

The seats are arranged and connected to the main arm 2 such the bottom 10*b* form a substantially a flat surface, substantially parallel to the ground G, on which the rider can be accommodated.

The expression the seat is connected to the main arm is used herein to indicate that the seats are associated with the main arm, and in particular with the first portion 2*a* of the main arm 2.

In particular, the seat 10 can be directly connected to the main arm 2, or indirectly by an additional element, for example, at least one support arm 11, as illustrated in the Figures.

The seat 10 is rotatably connected to the main arm 2, e.g., to the first portion 2*a* of the main arm 2, about a rotation axis C.

The rotation axis C of the seat 10 is substantially parallel with respect to the rotation axis B of the main arm 2.

The rotation axis C may be arranged on a plane that is perpendicular with respect to the central rotation axis A and/or tangent to the circular path of motion of the main arms 2 about the central axis A, or to a circumference having a center in the central axis A.

The seat 10 can be arranged at distance from the rotation axis C, and, e.g., the connection at a distance from the rotation axis C allows the rotation of the seat 10 in a plane that is perpendicular with respect to the rotation axis C.

For example, in the example embodiment illustrated in the Figures, the seat 10 is arranged at distance from the rotation axis C by the support arm 11. Therefore, the seat 10 connected to the support arm 11 is rotated at a distance from the rotation axis C, in a plane that is perpendicular with respect to the rotation axis C.

In detail, in the arrangement illustrated in the Figures, the support arm 11 is hinged on the main arm 2, and, e.g., on the first portion 2*a* of the main arm 2, thus allowing the rotation of the seat 10 with respect to the main arm 2.

The rotation of the seat 10 with respect to the main arm 2 can be limited, e.g., the rotation of the seat 10 is not completely free but it can be limited. As illustrated, for example, in FIGS. 1, 2, 2*a*, 3, and 4, the rotation of the seat 10 with respect to the main arm 2 may be controlled such that the seat 10 is maintained in a vertical direction with respect to the ground, during the raising and lowering movements of the first portion 2*a* of the main arm 2 with respect to the ground.

For this purpose, a four bar linkage 12, i.e., an articulated quadrilateral linkage, can be used to connect the seat 10 to the main arm 2 so that during the raising and lowering movements of the main arm 2, the seat 10, and also support arm 11 is maintained in a vertical position, i.e., in a position parallel to the central axis of rotation A.

In the arrangement illustrated in the Figures, the four bar linkage is formed by an additional linkage arm 12, arranged parallel to the main arm 2, and connected to the seat 10 (and in particular to the support arm 11), and to the rotation axis B (and in particular to the columns 6*b* on which the rotation axis B is arranged).

As illustrated, for example, in FIGS. 3*a*, 4*a*, and 7 to 11, the rotation of the seat 10 with respect to the main arm 2 is free and it can be controlled by control device 30 of the aerodynamic surface 20, as it will be discussed later.

The seat 10 is hinged on the main arm 2, and, in particular, by the support arm 11, so that the seat 10 can be rotated during the raising and lowering motion of the main arm 2.

It follows that the rotation of the seat 10 about the axis C depends on the forces acting on the seat 10, and also on the aerodynamic surface 20 that is also connected to the seat.

The movement of the seat 10 about the rotation axis C depends at least partially on the aerodynamic force generated by the aerodynamic surface 20. The rotation of the seat also depends on other forces, for example, the gravity force and the centrifugal accelerations acting on it due to the rotation of the main arm 2 about the central rotation axis A.

In addition, it is possible to include a dampening device to prevent over-swinging of the seat and/or a braking device to stabilize the seat during loading/unloading operations.

As mentioned above, the amusement ride 1 includes at least one aerodynamic surface 20 intended to generate an aerodynamic force due to the air flow impacting it during the rotation of the main arm 2 about the central axis A.

More in detail, the aerodynamic surface is, e.g., connected to the seat 10, or it can be connected to the main arm 2, and, as illustrated, for example, in the Figures, the aerodynamic surface 20 may be connected to the support arm 11 of the seat 10.

In general, the aerodynamic surface is connected to the seat 10 such that a rotation of the seat 10 about the rotation axis C is followed by the aerodynamic surface 20.

In the arrangement illustrated in the Figures, the aerodynamic surface 20 is constrained to the upper part of the support arm 11 to which the seats 10 are constrained.

The term aerodynamic surface is used herein to indicate a surface able to generate a force, e.g., a lift force, when air flow impacts on it.

Different shapes of the aerodynamic surface can be used, for example, a delta surface may be used. Also, the material used for the production of the aerodynamic surface can be different, e.g., rigid materials, deformable materials, etc. For example, plastic, impermeable membranes or fabrics, etc., can be used.

In general, the aerodynamic surface used in the amusement ride can be, e.g., a wing, kite, glider, etc.

The variation of the angle of incidence of an aerodynamic surface with respect to the relative air flow impacting it leads to a modification of the lift force generated.

The expression angle of incidence is used herein to indicate the angle formed by the aerodynamic surface with respect to the air flow. It can be seen as the angle of attack of the aerodynamic surface with respect to the relative air flow impacting it.

In general, the angle of incidence is used to indicate the inclination of the surface with respect to a horizontal vector of the air flow parallel to the ground.

For the purpose of modifying the angle of incidence, e.g., modifying the inclination of the aerodynamic surface with respect to the air flow, the aerodynamic surface 20 is rotatable about a rotation axis D.

The rotation axis D of the aerodynamic surface 20 is perpendicular with respect to the rotation axis C of the seat 10 with respect to the main arm 2 and/or with respect to the ration axis B of the main arm 2.

In the arrangement illustrated in FIGS. 1, 2, 2*a*, 3, 4, 5, and 6, the aerodynamic surface is formed by a main portion 21. Notwithstanding this, the aerodynamic surface 20 may include at least one flight control portion 22. For example, at least one main portion 21 and at least one flight control portion 22, movable with respect to the main portion 21, can be provided. This arrangement is illustrated, for example, in FIGS. 3*a*, 4*a*, and 7 to 11, in which the aerodynamic surface includes a pair of flight control portions 22, in order to control the movement of the seat 10, and, e.g., the rotation of the seat 10 about the rotation axis C.

The aerodynamic surface 20 may include at least a pair of flight control portions 22, e.g., controlled so that when one portion is moved downward, the other portion is moved upward.

For example, the at least one flight control portion is used to control the movement of the seat 10 with respect to the main arm 2, and, e.g., the rotation of the seat 10 with respect to the main arm 2 about the axis of rotation C.

The expressions moved downward and moved upward are used to indicated that the down-going control portion 22 increases the generated lift (aerodynamic force), while the up-going control portion 22 reduces the generated lift, thus generating a rotation movement of the seat 10 with respect to the main arm 2, about the rotation axis C.

The flight control portion 22 can be arranged at different positions with respect to the fixed main portion 21 of the aerodynamic surface. As illustrated, for example, in FIGS. 3*a*, 4*a*, and 7 to 11, the at least one flight control portion 22 may be arranged in correspondence of the trailing edge 23 of the main portion 21 of the aerodynamic surface 20.

In particular, the flight control portion 22 is hinged in correspondence of the trailing edge 23 of the aerodynamic surface 20, so that it can be rotated upward and downward with respect to the main portion 21 of the aerodynamic surface.

The amusement ride 1 includes a control device 30 for modifying the angle of incidence of the aerodynamic surface 20 with respect to air flow impacting on the aerodynamic surface 20, during the rotation of the main arm 2 about the central axis A and/or to control the movement of the seat 10 with respect to the main arm 2.

As mentioned above, the modification of the angle of incidence, i.e., the modification of the inclination of the aerodynamic surface 20 with respect to the relative air flow impacting it, allows for modification of the generated aerodynamic force, and, e.g., allows for modification of the amount of lift force generated by the aerodynamic surface 20.

The control device 30 intended to modify the incidence of the aerodynamic surface 20 may be operated by the at least one rider accommodated on the seat 10 of the ride 1.

The control device 30 may include at least one bar 31, 32, that is, e.g., manually operated by the rider so as to provide a direct control of the flight to the rider.

The control device 30 is operated to control the rotation of the aerodynamic surface 20 with respect to the rotation axis D and/or to control the movement of the seat with respect to the main arm, e.g., by controlling the movement of the at least one flight control portion 22 of the aerodynamic surface 20.

In other words, the control device 30 may be provided so as to provide a rotation of the aerodynamic surface 20 about the rotation axis D to modify its inclination with respect to the air flow, separately from, or in combination with, the control of the movements of at least one flight control portion 22, if present, of the aerodynamic surface 20.

For example, in the arrangement illustrated in FIGS. 1, 2, 2*a*, 3, 4, 5, and 6, the aerodynamic surface 20 is not provided with flight control portion 22. In this arrangement, the control device 30 is used to modify the inclination of the aerodynamic surface 20, and, e.g., its rotation about the rotation axis D.

In the arrangement illustrated in FIG. 3*a*, 4*a*, and 7 to 11, the aerodynamic surface 20 includes at least one flight control portion 22 and the control device 30 is intended to control the up and down movement of the flight control portion 22.

The control device 30 includes at least one bar 31, e.g., a horizontal bar, which is intended to control the incidence of the aerodynamic surface, and in particular the angle of incidence of the aerodynamic surface, e.g., by controlling its rotation about the rotation axis D.

The bar 31 is manually operated by the at least one rider by pulling the bar 31 toward the seat 10, or by pushing the bar 31 away from the seat 10.

If the bar 31 is moved toward the seat 10 (it is pulled by the rider), the angle of incidence of the aerodynamic surface may be reduced, and thus the aerodynamic lift force may be reduced, thus causing a lowering movement of the main arm 2 and also of the seat 10 connected thereto.

Figure 6:
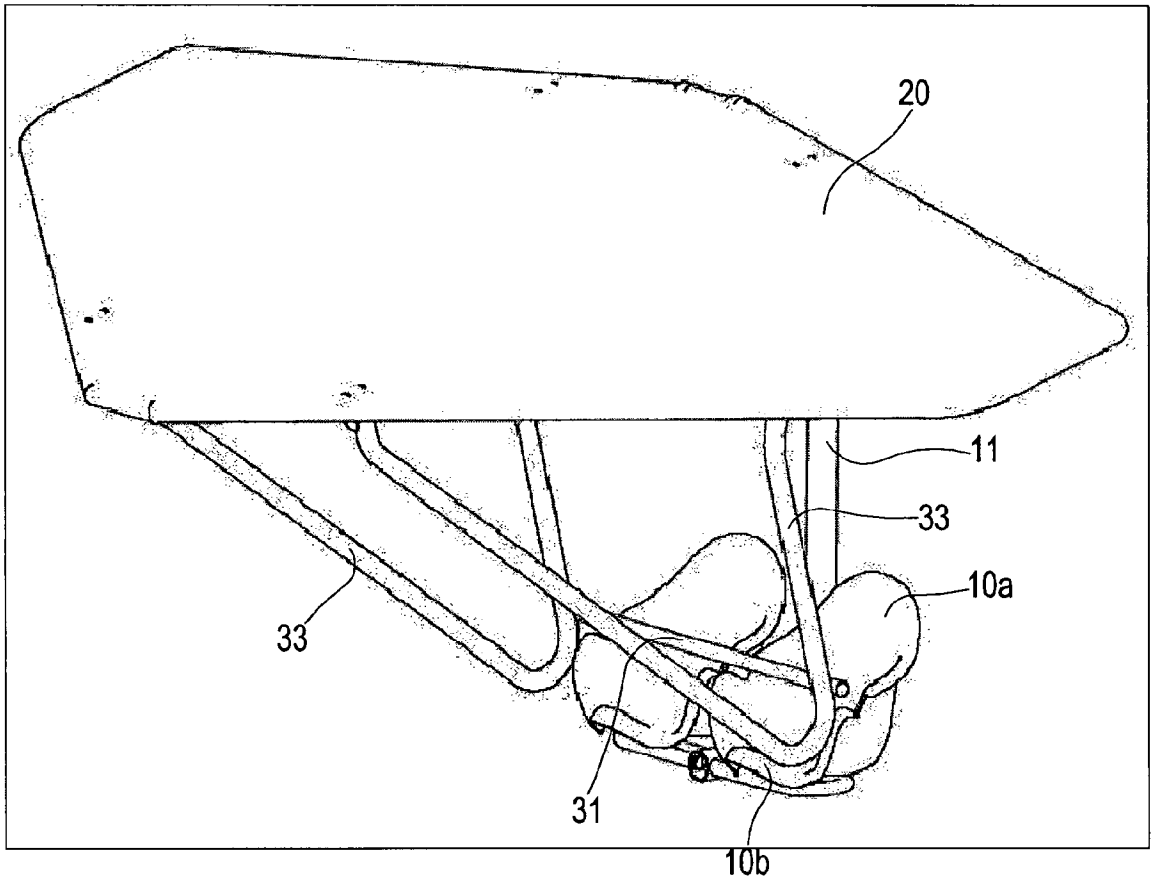
FIG. 6 is a detailed view of a seat provided with the aerodynamic surface in an inclined position causing the lowering movement with respect to the ground.
Figure 7:
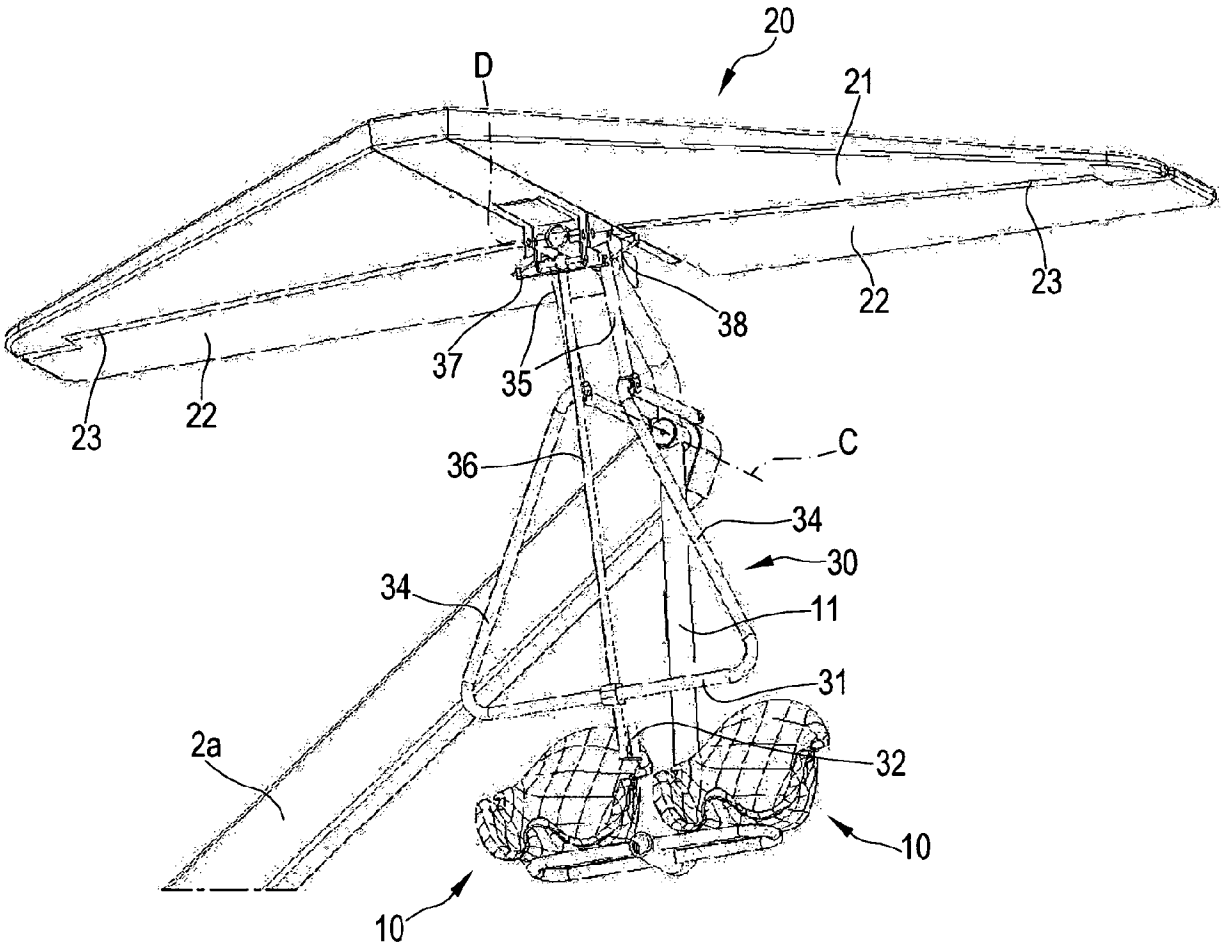
FIG. 7 is a detailed view of a seat and of the aerodynamic surface used in the ride illustrated in FIGS. 3*a* and 4*a*.
Figure 9:
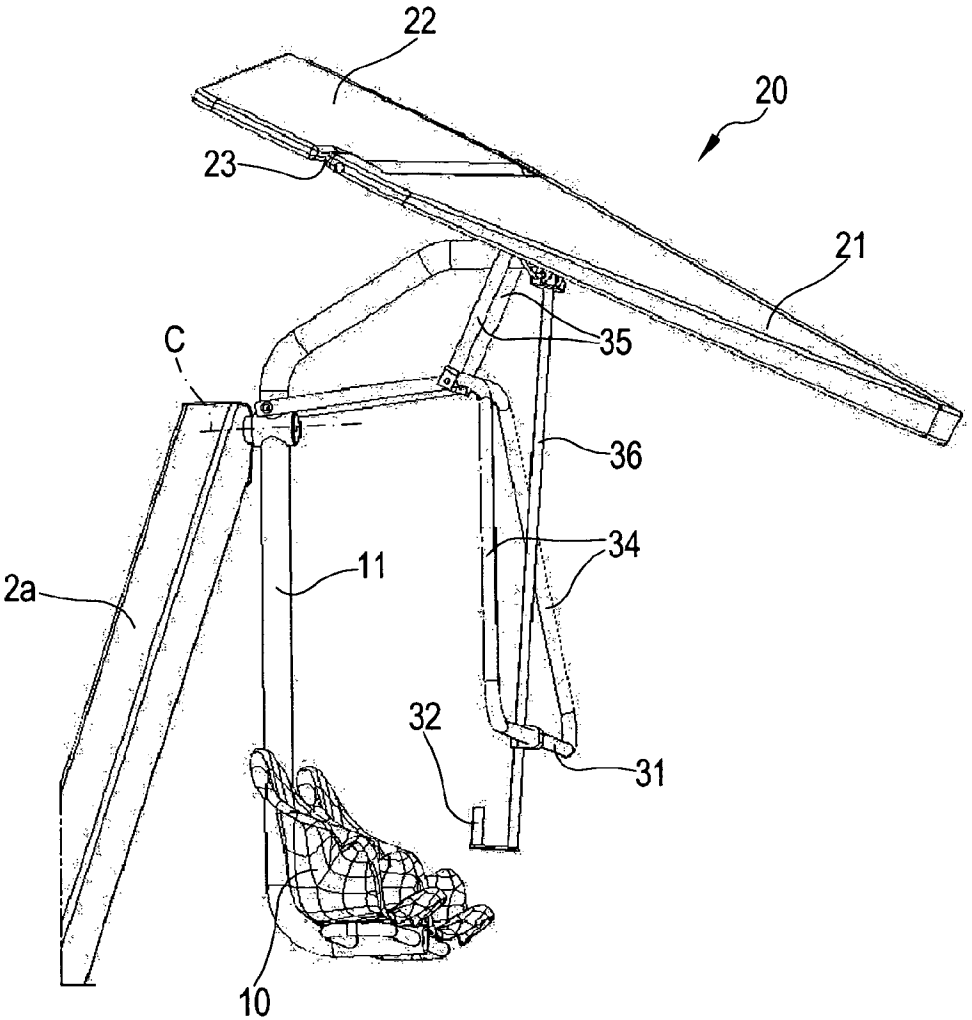
FIG. 9 illustrates the seat provided with the aerodynamic surface illustrated in FIGS. 3*a*, 4*a*, and 7 in a position causing the lowering movement with respect to the ground.

This position is illustrated in FIG. 6 as an example embodiment of the seat and the aerodynamic surface of the ride 1, and in FIG. 9 as an example embodiment of the seat and the aerodynamic surface provided with flight control portions 22 of the ride.

On the other hand, if the bar 31 is moved away from the seat 10 (it is pushed by the rider), the angle of incidence of the aerodynamic surface is increased and therefore the aerodynamic lift force generated is increased. It follows that a rising (climbing) movement of the main arm 2, and thus also of the seat 10 connected thereto is generated.

Figure 5:
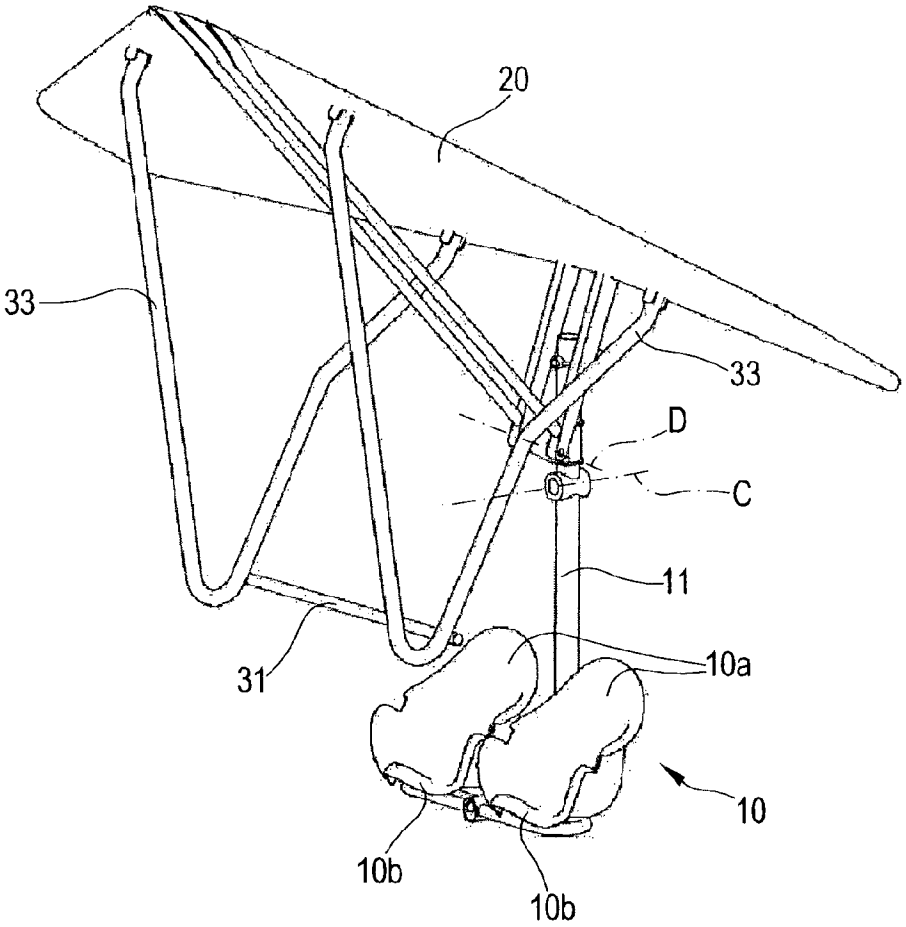
FIG. 5 is a detailed view of a seat provided with the aerodynamic surface in an inclined position causing the raising movement with respect to the ground.
Figure 8:
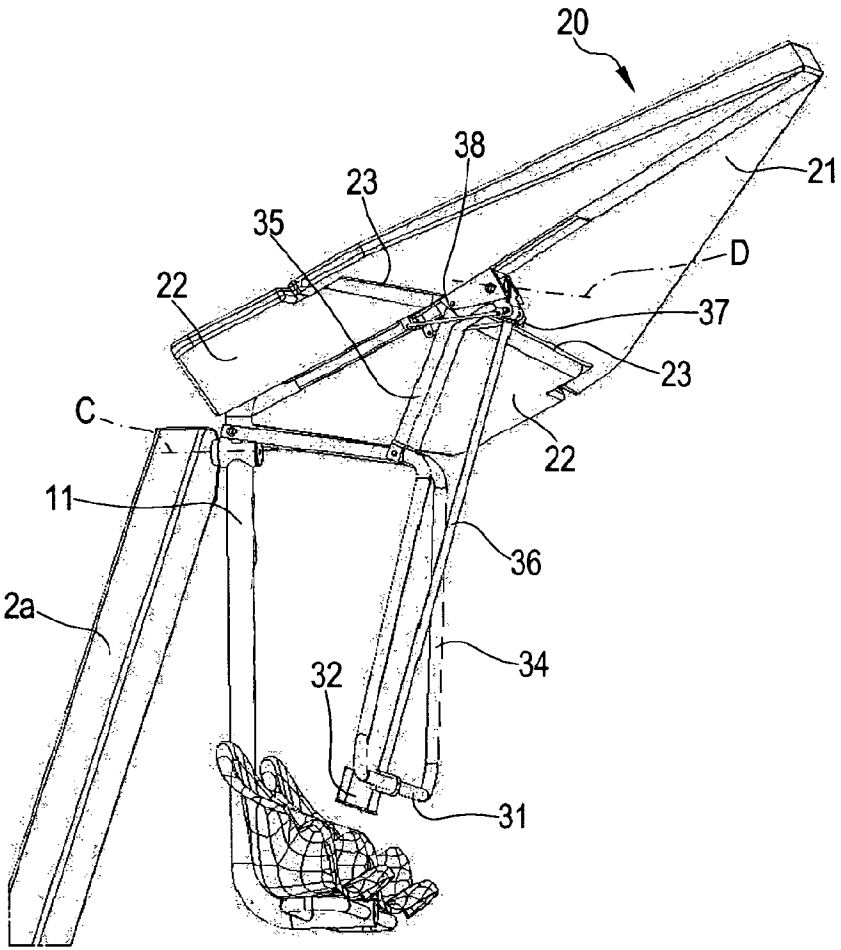
FIG. 8 illustrates the seat provided with the aerodynamic surface illustrated in FIGS. 3*a*, 4*a*, and 7 in a position causing the raising movement with respect to the ground.

This position is illustrated in FIG. 5 for an example embodiment of the seat and the aerodynamic surface of the ride 1, and in FIG. 8 for an example embodiment of the seat and the aerodynamic surface provided with flight control portions of the ride.

In the arrangement illustrated in FIGS. 1, 2, 2*a*, 3, 4, 5, and 6, the horizontal bar 31 is constrained to two side bars 33 which are directly connected to the aerodynamic surface.

In the arrangement illustrated in FIGS. 3*a*, 4*a*, and 7 to 11, the horizontal bar 31 is connected with two bars 34 connected to the support arm 11 of the seat 10, which in turn are connected to the aerodynamic surface by two additional bars 35.

Different configurations of the control device 30 and, e.g., of the kinematic linkage of the bar 31 to the aerodynamic surface, to generate the modification of the incidence of the aerodynamic surface 20, can be provided.

Additionally, as mentioned above, the arrangement illustrated in FIGS. 3*a*, 4*a*, and 7 to 11 is provided with a control device 32 for controlling the movements of the flight control portion 22. In particular, the control device 30 of the control portions 22 includes at least one bar 32, e.g., a substantially vertical bar 32 which is, e.g., manually operated by the rider. A rotation of the bar 32 controls the moment of the flight control portion 22, and, e.g., an upward movement or a downward movement. In particular, if at least one pair of flight control portions 22 is provided, a rotation of the bar 32 determines one flight control portion 2 to move upward or downward relative to the main portion 21 and the second flight control portion 22 to move in an opposite manner with respect to the first flight control portion 22.

As illustrated, for example, in FIGS. 3*a*, 4*a*, and 7 to 11, the linkage control device 30 which works the up and down motion of the control portions 22 starts with a bar 32 which is mounted in correspondence of the seat 10.

The rider operates the movement (rotation) of this bar 32. The bar 32 is connected to a shaft 36 which is substantially vertical, and sideways movement of the bar 32 causes the shaft 36 to rotate about its axis. At the top of the shaft there is a horizontal bar 37 and the rotation of the shaft 36 rotates this rigidly connected bar 37 such that one side moves towards the seat 10, and the other side moves away from the seat 10.

To each end of this bar are mounted straight tube elements 38 connected on each end through spherical joints. Rotation of the bar 36 causes these straight elements 38 to mainly translate along their axis.

The far end of the tube element 38 is connected to the flight control portion 22 which is, e.g., mounted on a horizontal pivot with respect to the main portion 21 of the aerodynamic surface 22. Axial displacement of the tube elements 38 causes the control portions 22 to pivot up or down relative to the main portion 21.

More in detail, as the ends of the bar 32 move in opposing directions, the left and right control portions 22 necessarily move in opposing directions: up and down or down and up, depending on the rotation direction of the bar 32.

Figure 10A:
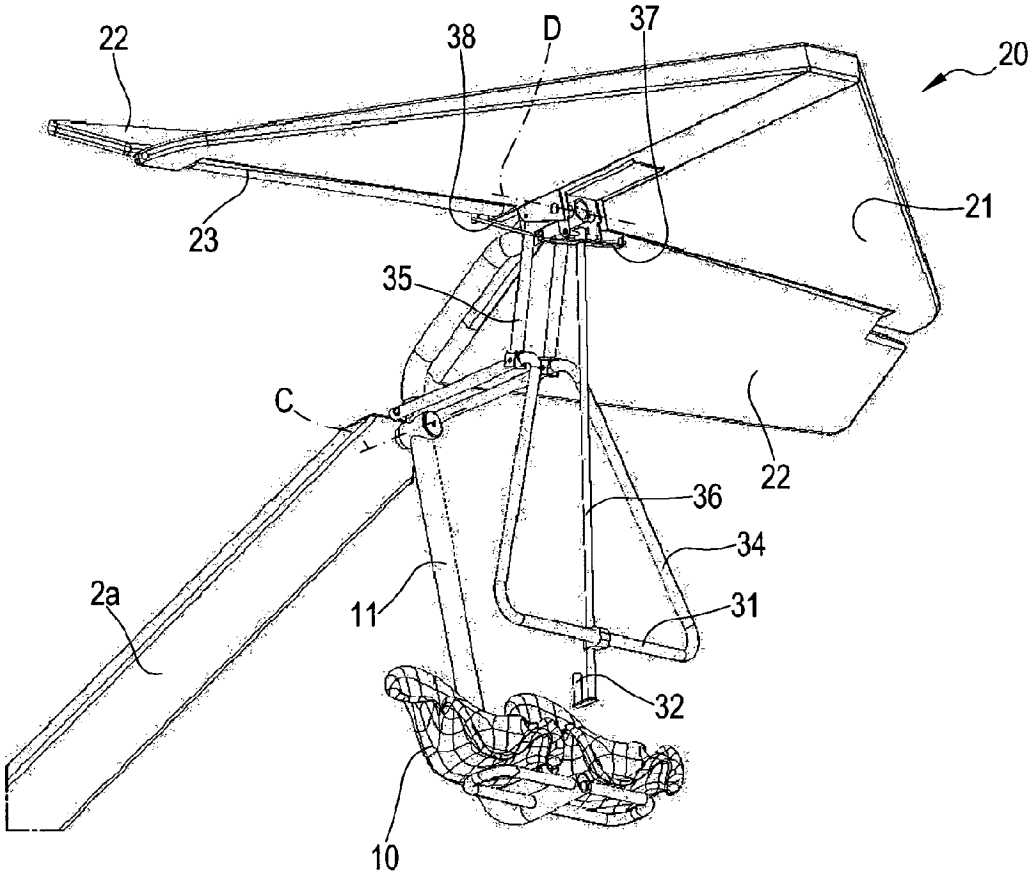
FIGS. 10*a* and 10*b* illustrate two positions of a pair of flight control portions of the aerodynamic surface according to FIGS. 3*a*, 4*a*, 7, 8, and 9.
Figure 10B:
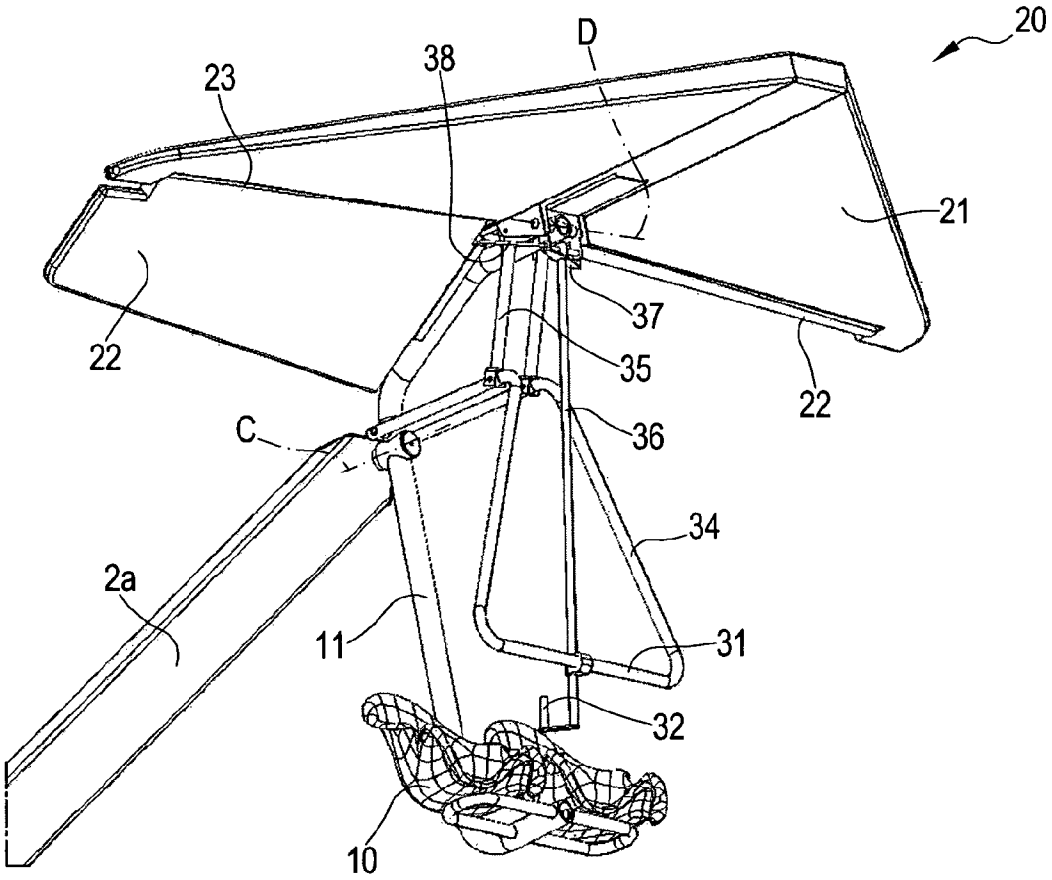
Figure 11A:
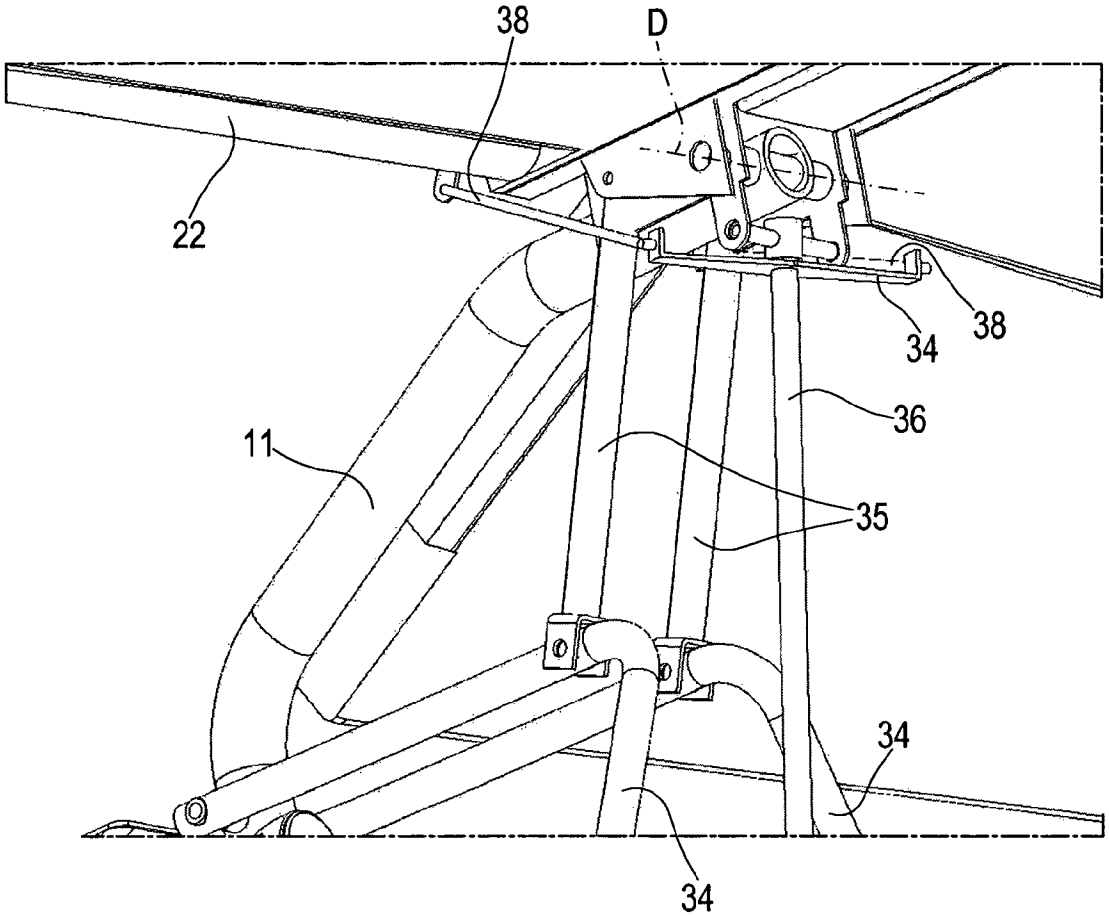
FIGS. 11*a* and 11*b* are detailed views of the kinematic linkage controlling the movement of the pair of flight control portions of the aerodynamic surface in the positions respectively illustrated in FIGS. 10*a* and 10*b*.
Figure 11B:
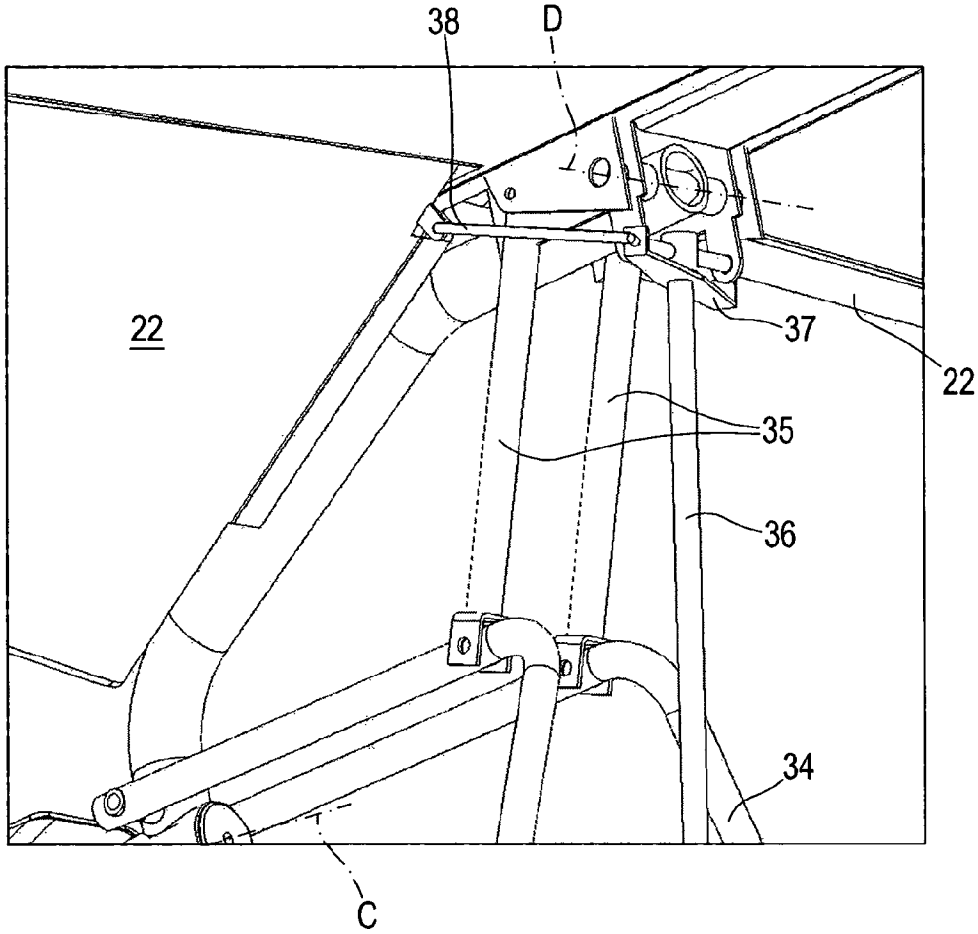

In particular, in the position illustrated in FIGS. 10*a* and 11*a*, the left control portion 22 is moved upward and the right control portion 22 is moved downward. In the position illustrated in FIGS. 10*b* and 11*b*, the left control portion 22 is moved downward and the right control portion 22 is moved upward.

Movement of the aerodynamic surface 20 to modify its incidence and controlled by the bar 31 does not notably influence the operation of the control portions 22, operated by the bar 32. In fact, the control portion 22 can be operated whether or not the main portion 21 of the aerodynamic surface 20 is moved by the bar 31.

A possible mode of operation of the amusement ride 1 is described with reference to a possible method of operating the ride 1.

The method includes loading the riders on the seats 10 connected to the plurality of main arms 2. The presence of a plurality of main arms 2 with the seat 10 connected thereto may allow an increased rider capacity in the ride 1.

The loading operations of the riders may be carried out when the seats 10 are close to the ground G, or to a platform, thus facilitating the embarkation/disembarkation operations.

For example, the main arms 2 and their first portions 2*a* to which the seat 10 is connected, are in a lowered position, e.g., illustrated in FIGS. 3 and 3*a*. In this position, further downward rotation of the first portion 2*a* of the main arm 2 can be prevented by the lower limit stop 8*a*. As illustrated, for example, in FIG. 3, the second portion 2*b* of the main arm is in contact with the lower limit stop 8*a* to prevent a further lower movement towards the ground G of the first portion 2*a* of the main arm 2.

In this position, the counterweight may be displaced in a position close to the rotation axis B of the main arm 2, so that the first portion 2*a* can reach a lowered position where the seat 10 is close to the ground G.

After the loading operations of the rider have been carried out, the method includes, e.g., balancing the main arm 2 with respect to the rotation axis B by the counterweight 5.

The method may include moving the at least one counterweight 5 to balance the main arm 2 with respect to the rotation axis B.

For example, the counterweight is moved, and, e.g., distanced from the rotation axis B so as to equilibrate (counterbalance) the weight of the riders loaded on the seat 10 connected to the first portion 2*a* of the main arm 2.

The counterweight 5 may be moved, e.g., by the activation of suitable moving device(s) (e.g., one or more linear actuators), such as, for example, a hydraulic actuator 5*a*, until a slight rotation of the main arm 2 about the rotation axis B is sensed.

A suitable sensor for detecting a modification of the angular position of the main arm about the rotation axis B can be provided.

When a rotation of the main arm 2 is detected, which implicitly indicates that the main arm 2 has reached, or it has just passed, a balanced position with respect to the rotation axis B, the movement of the counterweight 5 is stopped and maintained during the operation of the ride 1. The balanced position of the main arm 2 is maintained during the rotation of the main arms 2 along the circular path so as to allow the rider to raising and lowering the seat by simply modifying the incidence of the aerodynamic surface 20.

The method further includes activating the at least one motor M to move the plurality of main arms 2 along the circular path about the central rotation axis A.

During the rotation movement of the main arms 2, the method includes modifying the angle of incidence of the aerodynamic surface 20 with respect to the air flow, to cause the raising or lowering movements of the first portion 2*a* of the main arm 2 about the rotation axis B, and of the at least one seat 10 connected thereto.

For example, the modification of the angle of incidence of the aerodynamic surface is carried out manually by the rider, e.g., by directly operating the control device 30.

As mentioned above in connection to the amusement ride 1, in the operating method, the control device 30 is activated for modifying the angle of incidence of the aerodynamic surface 20, e.g., by controlling the rotation of the aerodynamic surface 20 with respect to the rotation axis D and/or to control the movement of the seat 10 with respect to the main arm 2, e.g., by controlling the movement of the at least one flight control portion 22. By doing so, the at least one seat 10 is rotated with respect to the main arm 2 about the rotation axis C.

At the end of the ride operation, the rotation movement of the main arms 2 about the central axis A is stopped and the main arms are returned in the lowered position, e.g., by retracting the counterweight, as, for example, illustrated in FIGS. 3 and 3*a*, wherein the seat 10 are close to the ground G, thus allowing the rider to be unloaded (disembarked) from the seat 10.

In this position, the at least one counterweight 5 can be moved in the position where it is close to the rotation axis B.

New riders can be subsequently loaded on the seat and the above reported steps can be repeated.

What is claimed is:

1. An amusement ride, comprising:

a plurality of main arms;

at least one motor adapted to move the main arms along a circular path about a central axis arranged substantially vertical to the ground and/to a platform, the main arms being rotatable about a rotation axis so that a first portion extends with respect to the rotation axis, the rotation of the main arm about the rotation axis allowing at least the first portion of the main arm to be raised or lowered with respect to the ground;

at least one seat for at least one rider connected to the first portion of the main arm;

at least one movable aerodynamic surface; and a control device adapted to modify an angle of incidence of the aerodynamic surface with respect to air flow impacting the aerodynamic surface during rotation of the main arm about the central axis to cause raising or lowering movements of the first portion of the main arm and of the at least one seat connected to the main arm;

wherein:

the at least one seat is rotatably connected to the first portion of the main arm about a further rotation axis, the at least one seat freely rotates with respect to the main arm, the at least one seat is connected to the main arm by a support arm, and the at least one aerodynamic surface is constrained to an upper part of the support arm to which the at least one seat is constrained.

2. The amusement ride according to claim 1, further comprising at least one counterweight adapted to balance the main arm.

3. The amusement ride according to claim 2, wherein the counterweight is movable with respect to the main arm.

4. The amusement ride according to claim 1, further comprising at least one support element adapted to support the main arm in correspondence of the rotation axis.

5. The amusement ride according to claim 4, wherein the support element is adapted to support the main arm at a distance from the central axis.

6. The amusement ride according to claim 4, wherein the support element includes a circular support bar.

7. The amusement ride according to claim 1, the rotation axis of the main arm is arranged distanced and/or arranged laterally from the central axis.

8. The amusement ride according to claim 1, wherein the main arm does not intersect the central axis.

9. The amusement ride according to claim 1, wherein the rotation axis of the main arm is located in a plane that is substantially perpendicular with respect to the central axis.

10. The amusement ride according to claim 1, wherein the rotation axis of the main arm is tangent to the circular path, or with respect to a circumference having a center located in the central axis.

11. The amusement ride according to claim 1, wherein the rotation axis is arranged between two ends of the main arm so that a first portion and a second portion extend opposite one to another with respect to the rotation axis.

12. The amusement ride according to claim 1, further comprising at least one lower limit stop and/or at least one upper limit stop adapted to limit an angle of rotation of the main arm about the rotation axis.

13. The amusement ride according to claim 1, wherein the further rotation axis of the at least one seat is substantially parallel with respect to the rotation axis of the main arm.

14. The amusement ride according to claim 1, wherein at least one of (a) rotation about the further rotation axis of the at least one seat with respect to the main arm is limited and (b) the seat is maintained in a vertical direction with respect to the ground and/or the platform during raising and lowering movements of the first portion of the main arm with respect to the ground and/or the platform.

15. The amusement ride according to claim 1, wherein rotation about the further rotation axis of the at least one seat with respect to the main arm depends at least partially on an aerodynamic force generated by the aerodynamic surface.

16. The amusement ride according to claim 1, wherein the aerodynamic surface includes at least one of (a) wing, (b) a kite, and (c) a glider.

17. The amusement ride according to claim 1, wherein the aerodynamic surface is rotatable about a further rotation axis to modify the angle of incidence of the aerodynamic surface to cause raising or lowering movements of the first portion of the main arm and of the at least one seat.

18. The amusement ride according to claim 17, wherein the further rotation axis of the aerodynamic surface is perpendicular with respect to a rotation axis of the at least one seat with respect to the main arm and/or with respect to the ration axis of the main arm.

19. The amusement ride according to claim 1, wherein the aerodynamic surface includes at least one flight control portion.

20. The amusement ride according to claim 19, wherein the aerodynamic surface includes at least one main portion, and the at least one flight control portion is movable with respect to the main portion.

21. The amusement ride according to claim 19, wherein the aerodynamic surface includes a pair of flight control portions.

22. The amusement ride according to claim 21, wherein the pair of flight control portions are operably controlled so that when one is moved downward, the other is moved upward.

23. The amusement ride according to claim 1, wherein the control device is operable by at least one rider accommodated on the at least one seat and/or includes at least one bar.

24. The amusement ride according to claim 1, wherein the control device is adapted to control rotation of the aerodynamic surface with respect to a second rotation axis and/or to control rotation movement of at least one seat with respect to the main arm about a third rotation axis.

25. The amusement ride according to claim 24, wherein the control device is adapted to control rotation movement of the at least one seat with respect to the main arm about the third rotation axis by controlling movement of at least one flight control portion of the aerodynamic surface.

26. A method of operating an amusement ride as recited in claim 1, comprising:

loading at least one rider on at least one seat connected to a plurality of main arms;

activating at least one motor to move the main arms along a circular path about a central rotation axis;

modifying an angle of incidence of an aerodynamic surface with respect to air flow, by activating, by the rider, a control device to cause raising and/or lowering movements of a first portion of the main arm about the rotation axis and of the seat connected to the main arm.

27. A method of operating an amusement ride, comprising:

loading at least one rider on at least one seat connected to a plurality of main arms;

activating at least one motor to move the main arms along a circular path about a central rotation axis;

modifying an angle of incidence of an aerodynamic surface with respect to air flow, by activating, by the rider, a control device to cause raising and/or lowering movements of a first portion of the main arm about the rotation axis and of the seat connected to the main arm;

wherein:

the at least one seat is rotatably connected to the first portion of the main arm about a further rotation axis, the at least one seat freely rotates with respect to the main arm, the at least one seat is connected to the main arm by a support arm, and the at least one aerodynamic surface is constrained to an upper part of the support arm to which the at least one seat is constrained.

28. The method according to claim 27, wherein the amusement ride is arranged as recited in claim 1.

29. The method according to claim 27, further comprising moving at least one counterweight with respect to the main arm, after loading the rider on the seat to reach a balanced position of the main arm with respect to the rotation axis.

30. The method according to claim 27, wherein the control device is activated for modifying the angle of incidence of the aerodynamic surface by controlling rotation of the aerodynamic surface with respect to the rotation axis and/or for controlling rotation movement of the seat with respect to the main arm about a rotation axis.

31. The method according to claim 30, wherein the control device is activated to control the rotation movement of the seat with respect to the main arm about the rotation axis by controlling movement of at least one flight control portion of the aerodynamic surface.

* * * * *